US005170596A

United States Patent [19]

Zadok et al.

[11] Patent Number: 5,170,596

[45] Date of Patent: Dec. 15, 1992

[54] DOUBLE GUTTER ASSEMBLY

[75] Inventors: Yigal Zadok, Daire; Mordechay Anati, Lauderhill, both of Fla.

[73] Assignee: Elite Aluminum Corporation, Pembroke Park, Fla.

[21] Appl. No.: 783,459

[22] Filed: Oct. 28, 1991

[51] Int. Cl.[5] ..... E04D 13/00; E04D 13/08

[52] U.S. Cl. ..... 52/16; 52/12

[58] Field of Search ..... 52/16, 1, 11, 12, 13, 52/14, 15, 60, 94, 95, 96

[56] References Cited

U.S. PATENT DOCUMENTS 3,967,419 7/1976 Robinson ..... 52/16

4,912,888 4/1990 Martin ..... 52/11

*Primary Examiner*—David A. Scherbel

*Assistant Examiner*—Beth A. Aubrey

*Attorney, Agent, or Firm*—Joseph C. Mason, Jr.; Ronald E. Smith

[57] ABSTRACT

A gutter assembly that includes a primary gutter and a secondary gutter that are connected to one another and attached to a roof panel. Water is inhibited from flowing between the primary gutter and a panel edge by a flange that overlies the roof panel. The end of the flange has a feather edge so that water atop the panel is directed onto the top of the flange and into the primary gutter. The primary gutter is spaced apart from the edge of the roof panel by a stop member that depends from the flange and that abuts the edge of the panel so that no water can collect between the gutter and the panel edge. This prevents deterioration of the panel. The panel edge also overhangs the secondary gutter to further ensure that no water collects on the panel edge. Drop outlet openings are formed in both gutter parts, and the opening in the secondary gutter is larger than the opening in the primary gutter to prevent water buildup in the primary gutter.

13 Claims, 2 Drawing Sheets

DOUBLE GUTTER ASSEMBLY

TECHNICAL FIELD

This invention relates, generally, to gutter constructions. More particularly, it relates to a double gutter construction where water that leaks past a primary gutter is collected by a secondary gutter and water collected by the primary gutter is delivered to a drop outlet without interference from the secondary gutter.

MODULAR ART

Modular insulated roof panels are used to create roofs for add-on structures, room additions, carports and the like. They are also used in roof-over applications, i.e., to insulate existing roofs of add-on structures, mobile homes, or other structures. Thus, the panels are often positioned adjacent to existing conventional roofs and must handle their own water drainage as well as drainage from the conventional roof.

The panels are easy to work with and perform well when properly assembled, but the attachment of gutters to the panels has been problematic. More specifically, water leaks along the panel seams and where the gutter is attached to the roof panels; since the gutter is attached to the edge of the panels, the water is trapped in the narrow space between the gutter and the panel edge and this leads to deterioration of the panel and still greater leakage.

The art has developed three basic types of gutter construction that are designed for mounting to roof panels, but none of the designs has solved the problem of water seepage through the seam. These types are known as the "G" gutter, the "T" gutter, and the "E" gutter; each takes its name from the general configuration of the gutter in transverse section or end view.

All three of the known gutter constructions have a flange that overlies the roof panel to which the gutter is attached, and a side wall that abuts the edge of the roof panel. Water collects at the end of the flange because said end acts as a dam; some of the dammed water seeps under the flange and flows or collects between the side wall of the gutter and the edge of the roof panel, thereby defeating the purpose of the gutter and damaging the panel as well.

The art suggests that better sealants are needed to prevent this troublesome seepage, and that frequent maintenance and re-application of sealing compound might forestall unwanted leakage. However, the art contains no teachings and suggestions that would impel one of ordinary skill in this art to build a gutter construction of revolutionary design that would solve the water intrusion problem in the absence of improved sealants and more frequent maintenance procedures.

DISCLOSURE OF INVENTION

A unique double gutter construction includes a primary gutter and a secondary gutter that are hingedly interconnected to one another along the bottom of the primary gutter and the top of the secondary gutter. The hinged interconnection enables facile cleaning of the secondary gutter as needed. The primary and secondary gutters may also be integrally formed with one another.

A flange integral with the primary gutter overlies the roof panel to which the novel double gutter is attached and a flange integral with the secondary gutter underlies that roof panel; the roof panel overhangs a side wall of the secondary gutter to ensure that any moisture on the panel edge falls into the secondary gutter.

The overlying flange has a feathered edge that prevents damming of the water by directing the water to the top of the flange and hence into the primary gutter.

A stop member depends from said overlying flange to space the primary gutter a predetermined distance from the edge of the roof panel so that if water does seep under the feathered edge, it does not collect between the gutter and the panel edge.

Water seeping under the flange flows directly into the secondary gutter, and into a drop outlet through a drop outlet opening formed in the bottom wall of the secondary gutter at a preselected end thereof. Water collected by the primary gutter exits through a drop outlet opening, formed in the bottom wall of the primary gutter, that is positioned in cooperative alignment with the drop outlet opening formed in the secondary gutter. The drop outlet opening in the secondary gutter is larger than its counterpart formed in the primary gutter to avoid water build up in the latter.

Thus it should be understood that an important object of this invention is to revolutionize the art of gutter construction by providing the world's first double gutter construction and all the benefits derived therefrom.

Another object is to provide the world's first hingedly interconnected double gutter construction.

Still another very important object is to provide the first gutter construction where a stand off means is provided to space the gutter from the edge of the roof panel to which it is attached to prevent water buildup therebetween.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims

BRIEF DESCRIPTION OF THE DRAWINGS

For a fuller understanding of the nature and objects of the invention, reference should be made to the following detailed description, taken in connection with the accompanying drawings, in which.

BEST MODES FOR CARRYING OUT THE INVENTION

Figure 1:
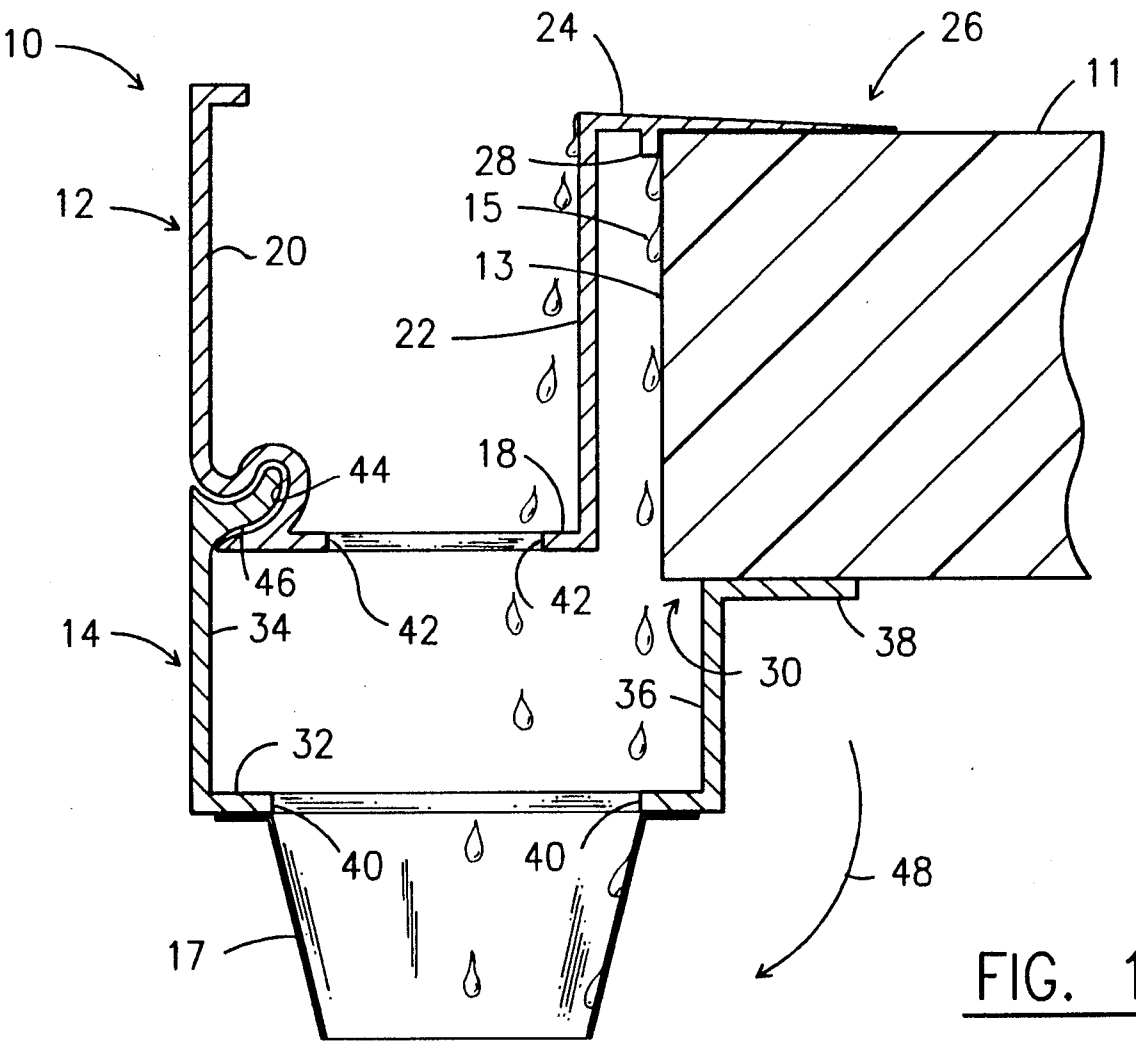
FIG. 1 is a transverse sectional view of an exemplary embodiment of the inventive double gutter assembly.

Referring now to the Figure, it will there be seen that an illustrative embodiment of the present invention is denoted as a whole by the reference numeral 10.

Double gutter 10 includes primary gutter 12 and secondary gutter 14 that are hingedly connected to one another by a hinge means denoted 16, generally. In a second embodiment, shown in FIG. 2, hinge 16 is eliminated and the gutters are integrally formed with one another.

Primary gutter 12 includes a flat bottom wall 18 and a pair of parallel, upstanding side walls 20, 22 that are integral with opposite edges of said bottom wall 18.

A flange 24 extends laterally from a top edge of primary gutter side wall 22; it overlies and is secured to an insulated roof panel 11. Its free end 26 is specifically formed to defeat the damming effect of prior art flanges; more particularly, said free end is formed into a feathered edge so that water atop roof panel 11 is directed by the feathered edge to flow atop said flange 24 and not under it. To minimize cutting injuries that might be caused by a sharp feathered edge, the edge is rounded off somewhat in a bull nose construction.

Feathered edge 26 represents an improvement over the water-damming edges of the prior art, but some water may still seep under flange 24 if driven by high winds; an important feature of this invention is the structure that deals with such seepage.

The structure includes stop member 28 that is integral with flange 24 and which depends therefrom as shown. Stop member 28 abuts edge 13 of panel 11 and thus spaces side wall 22 from said edge 13 as depicted. Note water droplets 15 that have seeped under flange 24; in the gutter constructions heretofore known, seepage water 15 would build up between panel edge 13 and the abutting sidewall of the gutter, i.e., side wall 22 of a conventional gutter would abut panel edge 13 and water 15 would flow slowly or collect in the small space therebetween, gradually deteriorating the panel and leading to increased leakage. Stop member 28 performs a stand-off function and clearly obviates this problem; its provision represents a significant advance in the gutter industry.

Seepage water 15 is also unimpeded as it flows down panel edge 13 by the overhang of the panel 11 relative to the secondary gutter; said overhang is denoted 30. Water 15 is collected within secondary gutter 14 in the manner depicted after it has flowed down panel edge 13.

Secondary gutter 14 includes flat bottom wall 32 and parallel, upstanding side walls 34, 36. Flange 38 extends laterally from side wall 36 and underlies panel 11; the flange 38 is secured to said panel by suitable means such as a screw member.

Note that bottom wall 32 has a greater breadth than bottom wall 18 of the primary gutter, and that, accordingly, the secondary gutter 14 has a greater breadth than primary gutter 12.

A generally tubular drop outlet 17, to which a generally upstanding tubular downspout, not shown, is conventionally affixed, depends from a preselected end of secondary gutter 14. A drop outlet opening 40 of predetermined diameter is formed in bottom wall 32 of the secondary gutter in registration with the drop outlet, and a drop outlet opening 42 having a predetermined diameter is also formed in the bottom wall 18 of the primary gutter. The diameter of drop outlet opening 40 is greater then the diameter of drop outlet opening 42 so that water cannot collect in the secondary gutter, i.e., the greater diameter of secondary gutter drop outlet opening 40 relative to the diameter of the primary gutter drop outlet opening 42 ensures that the former will drain water at a faster rate than the latter.

Hinge 16 includes an elongate cavity 44 formed along the extent of the lowermost end of side wall 20 of the primary gutter and receives a mating protuberance 46 formed along the extent of the uppermost end of side wall 34 of the secondary gutter. Note that cavity 44 extends upwardly relative to bottom wall 18 and inwardly relative to side wall 12 and that protuberance 46 is similarly oriented.

When debris collects in the secondary gutter, the screw that holds flange 38 to the underside of panel 11 is removed and the secondary gutter is then swung about hinge 16 in the direction indicated by the single-headed directional arrow 48 so that said secondary gutter may be cleaned as needed.

Figure 2:
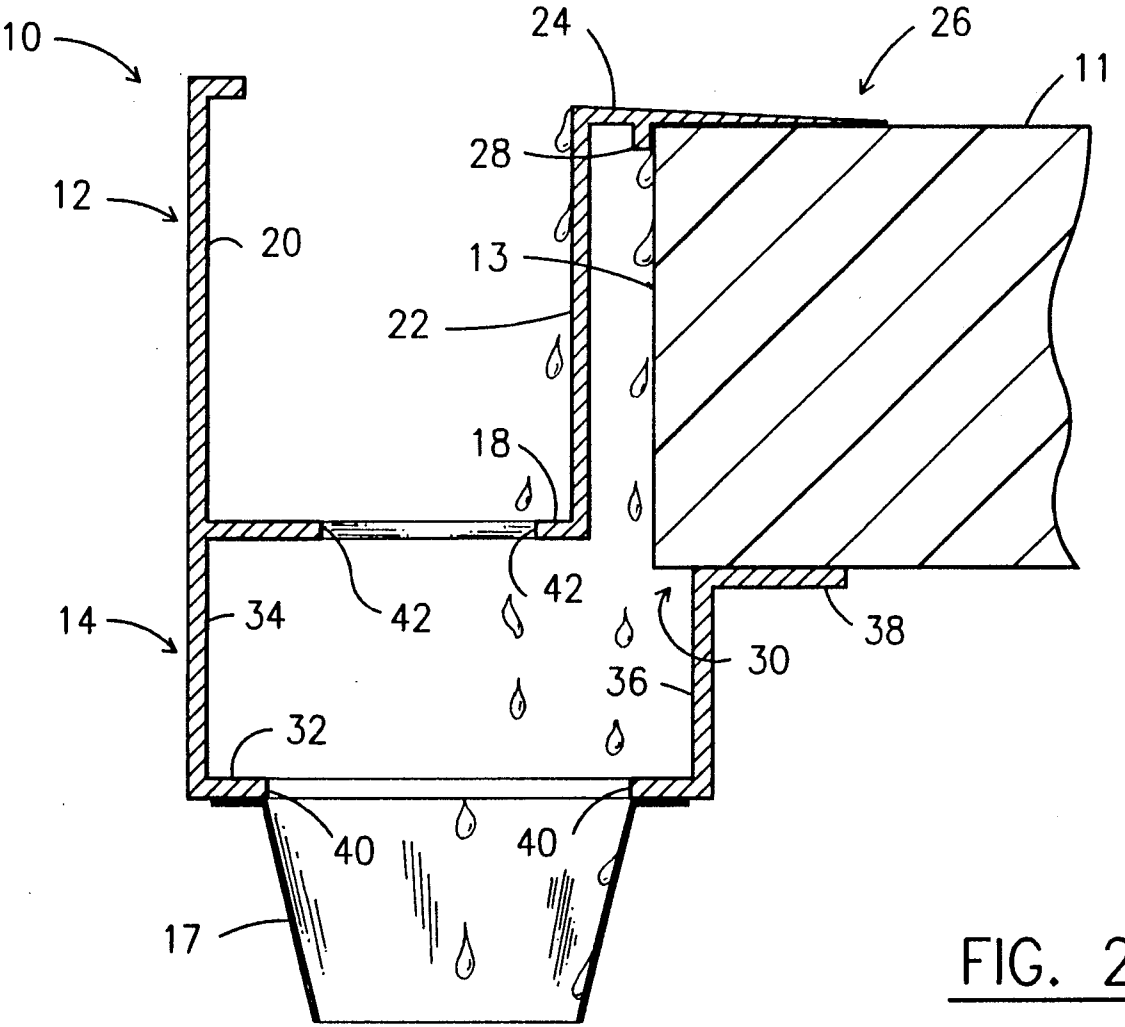
FIG. 2 is a transverse sectional view of a second exemplary embodiment.

In the FIG. 2 embodiment where hinge 16 is eliminated and the gutters are formed as a single unit, cleaning of the gutters is more difficult to accomplish. More particularly, cleaning is then accomplished by removing a piece of fascia or the sides of the roof.

The novel double gutter 10 thus includes numerous features and advantages that advance the art because none of the above-pointed out features were heretofore known, anywhere in the world.

This invention is clearly new and useful. Moreover, it was not obvious to those of ordinary skill in this art at the time it was made, in view of the prior art considered as a whole as required by law.

This invention pioneers the art of double gutter construction. Accordingly, the claims that follow are entitled to broad interpretation, as a matter of law, to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A gutter assembly, comprising:

a primary guttery including an outer side wall and an inner side wall and a substantially imperforate bottom wall;

said bottom wall has an opening for a downspout; a secondary gutter including an outer side wall and an inner side wall and a substantially imperforate bottom wall; said bottom wall has an opening for a downspout;

said primary gutter being disposed above said secondary gutter;

said primary gutter and said secondary gutter being interconnected to one another at a preselected location;

said predetermined location being along the extent of a lowermost edge of said primary gutter outer side wall and an uppermost edge of said secondary gutter outer side wall; and a stand off means for mounting said primary gutter in spaced relation to a roof panel so that water that flows over an edge of said roof panel flows downwardly into said second gutter and does not collect between said edge and said primary gutter.

2. The gutter assembly of claim 1, further comprising a hinge means for hingedly interconnecting said primary and secondary gutters so that said secondary gutter can be swung about said hinge means and cleaned.

3. The gutter assembly of claim 1, wherein said primary gutter includes a bottom wall, a pair of parallel upstanding side walls, a flange that extends laterally from a top edge of a preselected side wall and which overlies said roof panel, and wherein said stand off means is provided in the form of a stop member that depends from said flange, said stop member disposed in abutting relation to an edge of said roof panel when the gutter assembly is installed and said stop member disposed in spaced relation to the side wall from which said flange extends so that the distance between the stop member and said side wall determines the spacing between said roof panel and said primary gutter, said spacing being sufficient to prevent collection of water between said panel edge and said primary gutter side wall from which said flange extends.

4. The gutter assembly of claim 3, further comprising means for inhibiting water from flowing under said flange, said means provided by a preselected shape of said flange at a free end thereof, said preselected shape being a feathered edge, said feathered edge directing water on said roof panel to a top side of said flange so that said water flows into said primary gutter.

5. The gutter assembly of claim 4, wherein said feathered edge includes a rounded off edge to avoid cutting an individual handling said gutter assembly.

6. The gutter assembly of claim 2, wherein said primary gutter includes a bottom wall and a pair of parallel, upstanding side walls, wherein said secondary gutter includes a bottom wall and a pair of parallel, upstanding side walls, wherein a preselected side wall of said primary gutter includes an elongate cavity formed therein along its extent at a lowermost end thereof, and wherein a preselected side wall of said secondary gutter includes an elongate protuberance adapted to be received within said cavity, whereby said cavity and protuberance collectively form said hinge means.

7. The gutter assembly of claim 6, wherein said cavity extends upwardly relative to said primary gutter bottom wall and inwardly relative to said primary gutter preselected side wall, and wherein said protuberance is formed at a top edge of said preselected side wall of said secondary gutter.

8. The gutter assembly of claim 1, wherein said secondary gutter includes a bottom wall, a pair of parallel, upstanding side walls, and a flange that extends laterally outwardly from a top edge of a preselected side wall of said secondary gutter into underlying relation to a bottom wall of said roof panel, said flange being secured to said roof panel bottom wall.

9. The gutter assembly of claim 8, wherein said roof panel bottom wall overhangs said flange so that water flowing downwardly on an edge of said roof panel is directed into said secondary gutter and is unimpeded in said flow by said flange.

10. The gutter assembly of claim 3, wherein said secondary gutter has a breadth greater than the breadth of said primary gutter so that water flowing under said flange falls into said secondary gutter.

11. The gutter assembly of claim 10, further comprising a drop outlet depending from a preselected end of said secondary gutter, and a drop outlet opening formed in said secondary gutter bottom wall where said drop outlet depends from said secondary gutter so that water in said secondary gutter may flow through said drop outlet opening and into said drop outlet.

12. The gutter assembly of claim 11, further comprising a drop outlet opening formed in said primary gutter bottom wall, said primary gutter drop outlet opening being positioned in generally vertically aligned relation to said secondary gutter drop outlet opening so that water in said primary gutter exits said primary gutter through said primary gutter drop outlet opening.

13. The gutter assembly of claim 12, wherein the secondary gutter drop outlet opening has a predetermined diameter greater than a predetermined diameter of said primary gutter drop outlet opening so that water drains from said secondary gutter into said drop outlet faster than water drains from said primary gutter into said secondary gutter.

* * * * *